US005183115A

United States Patent [19]

Gano

[11] Patent Number: 5,183,115

[45] Date of Patent: Feb. 2, 1993

[54] SAFETY VALVE

[75] Inventor: John C. Gano, Carrollton, Tex.

[73] Assignee: Otis Engineering Corporation, Dallas, Tex.

[21] Appl. No.: 733,134

[22] Filed: Jul. 19, 1991

[51] Int. Cl.[5] ..... E21B 34/08

[52] U.S. Cl. ..... 166/319; 137/460; 137/498; 166/320; 166/322

[58] Field of Search ..... 166/319, 322, 320; 137/498, 460, 499

[56] References Cited

U.S. PATENT DOCUMENTS

| | | | |
|---|---|---|---|
| 3,070,119 | 12/1962 | Raulins | 137/460 |
| 3,236,255 | 2/1966 | Sizer | 137/494 |
| 3,477,507 | 11/1969 | Page, Jr. | 166/322 |
| 3,799,192 | 3/1974 | Young | 166/322 X |
| 3,802,504 | 4/1974 | Garrett | 166/322 X |
| 3,830,296 | 8/1974 | Shirley | 137/460 X |
| 3,881,511 | 5/1975 | Dollison | 137/460 |
| 3,889,751 | 6/1975 | Peters | 166/319 |
| 3,978,922 | 9/1976 | Johnson et al. | 166/322 |
| 4,339,001 | 7/1982 | Paschal | 166/322 |
| 4,664,195 | 5/1987 | Deaton | 166/323 |
| 4,708,163 | 11/1987 | Deaton | 137/460 |
| 4,890,674 | 1/1990 | Le | 166/319 |

OTHER PUBLICATIONS

"Otis Products and Services" OEC 5516, Sep., 1989, p. 142.

*Primary Examiner*—Hoang C. Dang

*Attorney, Agent, or Firm*—Roland O. Cox

[57] ABSTRACT

Disclosed is a new and novel poppet type safety valve useful in flow conduits in fluid storage well systems. The safety valve is programmable to automatically close at various predetermined ratios of production mass flow rate-ambient pressure to prevent undesirable high flow rates or uncontrolled out-flow of fluid stored in a reservoir if the flow conduit or wellhead is damaged. This safety valve is lowered into and locked and sealed in a landing nipple in the well conduit. The safety valve has a variable bias which biases the valve member toward open position and a variable flow restrictor which is automatically actuated by a sensing actuator continually sensing reservoir pressure to vary the restricted annular flow area between the valve housing and inside of the well conduit for closure at the desired flow rate. The valve element has a through flow passage with locking recesses in the flow passage into which the sensing actuator may be releasably locked. The sensing actuator responds to changes in stored gas density and ambient pressure and automatically varies the restricted flow area accordingly. The safety valve may be operated to disconnect the valve housing, with or without the sensing actuator, for expending downwardly in the well conduit.

18 Claims, 3 Drawing Sheets

SAFETY VALVE

BACKGROUND OF INVENTION

1. Technical Field

The present invention pertains to safety valves useful to control flow in well conduits. This invention pertains to a safety valve, particularly useful in gas storage systems, which automatically closes when production mass flow reaches a predetermined rate at a particular ambient pressure.

2. Background Information

A considerable number of pressure-differential type safety valves are known for wells, which are direct-controlled, i.e., actuated, to close because fluid flow through generates differential pressure and sufficient closing force in these valves. An example of a direct-controlled (or flow actuated) safety valve is shown on page 142 of "Otis Products and Services" (OEC 5516), a September, 1989 publication of Otis Engineering Corporation, Belt Line at Webbs Chapel Roads, P.O. Box 819052, Dallas, Tex. 75381-9052. Another example of a direct-controlled safety valve is shown in application Ser. No. 07/699,368, filed in the United States Patent and Trademark Office May 13, 1991, for applicants William W. Dollison and John C. Gano.

Other examples of flow actuated safety valves are shown in the following U.S. Patents. U.S. Pat. No. 4,708,163 to Deaton discloses a valve which compares pressure of fluid flowing through the valve to pressure exterior of the valve. If the differential pressure exceeds a predetermined value, a pressure sensitive bellows is actuated to close the valve.

U.S. Pat. No. 4,664,195 to Deaton covers another direct acting (controlled) safety valve. If the rate of change of fluid pressure flowing through this valve exceeds a preselected value, a pressure sensitive piston will close the valve.

U.S. Pat. No. 4,339,001 to Paschal, Jr., is for a differential operated safety valve which is held open until the difference in pressure between fluid in a chamber inside the valve and fluid flowing through the valve exceeds a preselected value causing the valve to close.

U.S. Pat. No. 3,881,511 to Dollison discloses a well safety valve utilizing a poppet type valve which is actuated to close when the flow rate through the valve induces sufficient pressure differential in the valve to actuate the valve to close.

Inventor Phillip S. Sizer utilizes a ball type valve in the safety valve structure of U.S. Pat. No. 3,236,255. The ball valve is rotated to close in one form of the safety valve when the pressure above the ball valve drops below a predetermined value and in another form when the flowing pressure differential across the ball valve exceeds a predetermined value.

U.S. Pat. No. 3,070,119 to G. M. Raulins shows another direct controlled safety valve structure which is actuated to close when a predetermined value of differential flowing pressure below and above an orifice is reached.

All previously noted patents are incorporated herein for reference.

DISCLOSURE OF THE INVENTION

The present invention provides a safety valve which may be programmed to close at predetermined and various ratios of mass flow rate and ambient reservoir pressure when producing or withdrawing stored gas through the valve from a reservoir. This valve has sensing means which continually read the ambient pressure of fluid stored in the reservoir and automatically adjusts the restricted withdrawal flow area to cause closure of the valve at the predetermined mass flow rate. A system utilizing the programmable safety valve includes a landing nipple installed at the proper level in a well flow conduit, a locking mandrel to which the valve housing is releasably connected and which may be lowered in the conduit to locate, seal and lock in the landing nipple. A valve member in the valve housing is adjustably biased towards open position and a variable flow restrictor device is mounted on the valve member. The restrictor device includes a number of petal-like restrictor segments which are moveable radially inward and outward to vary the restricted flow area between the outside of the valve member and inside of the flow conduit. The valve member has internal locking recesses into which a lock mandrel carrying a sensing actuator seals and is releasably locked for retrieval. The sensing actuator continually senses ambient pressure and automatically varies the restricted flow area for automatic closure at the predetermined flow rate. When the sensing actuator is retrieved, the valve member is full open for passage of well tools. The sensing actuator utilizes a variable volume bellows chamber and a surrounding spring to continually sense pressure in the reservoir and automatically reposition the restrictor segments to cause the safety valve to close at the predetermined withdrawal mass flow rate. The sensing actuator may be retrieved to change operating parameters and reinstalled in the safety valve. The valve housing may be disconnected for expending downward and the valve housing lock mandrel retrieved leaving the flow conduit full open. Gas may be pumped or injected down the well conduit and through the safety valve and into the reservoir for storage. The system and safety valve will operate the same in vertical or deviated well conduits.

An object of this invention is to provide a safety valve for storage wells which may be programmed to close automatically at various predetermined ratios of withdrawal mass flow rate and ambient pressure.

Another object of this invention is to provide a storage well safety valve which continually senses the pressure of gas stored in a reservoir and automatically varies the restricted flow area for closure at the predetermined production mass flow rate.

Another object of this invention is to provide a safety valve which may be lowered into a well conduit and releasably locked in a landing nipple in the flow conduit and retrieved therefrom or expended downwardly.

Also an object of this invention is to provide a safety valve having a sensing actuator which may be retrieved for changing operating parameters and reinstalled in the safety valve without retrieving the safety valve.

BEST MODE FOR CARRYING OUT THE INVENTION

Figure 1:
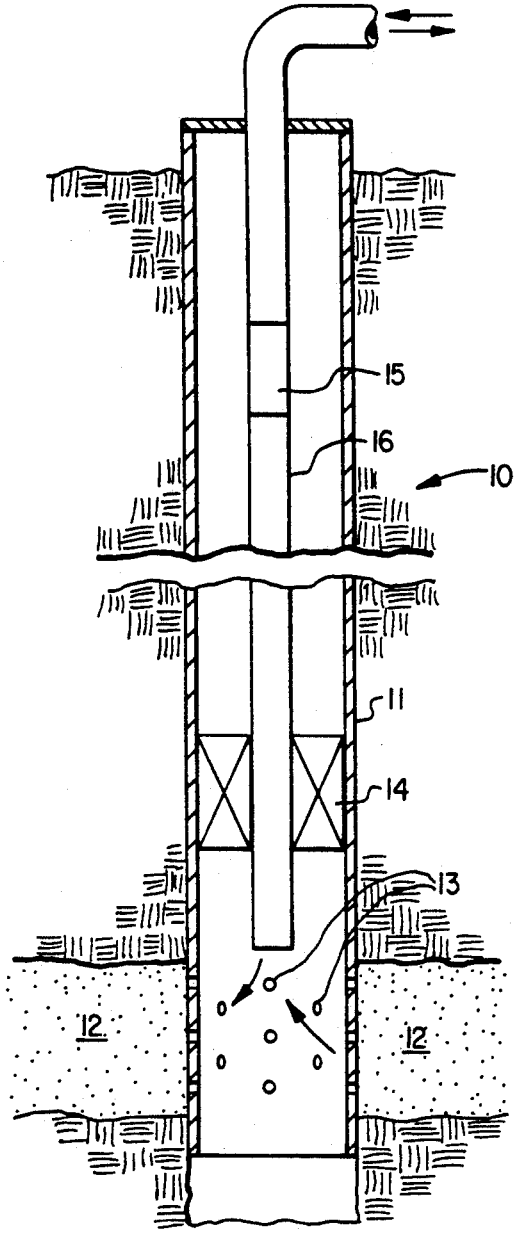
FIG. 1 is a schematic drawing of a storage well utilizing the system and safety valve of this invention.

FIG. 1 depicts a storage well 10 completed to utilize the system and programmable safety valve of this invention. Casing 11 has been installed and sealed in a hole bored through a formation 12 defining an underground reservoir. Perforations 13 through the casing provide pressure communication between the reservoir and inside of the casing. A packer 14 and a landing nipple 15 have been connected at proper levels in flow conduit 16 and lowered into the casing. The packer has been operated to anchor and seal inside the casing. As much fluid as possible has been recovered from the reservoir and fluids may now be injected into the reservoir for storage. Natural gas is injected into most storage wells or reservoirs during warmer weather to be withdrawn during cold weather for home heating purposes.

Figure 3:
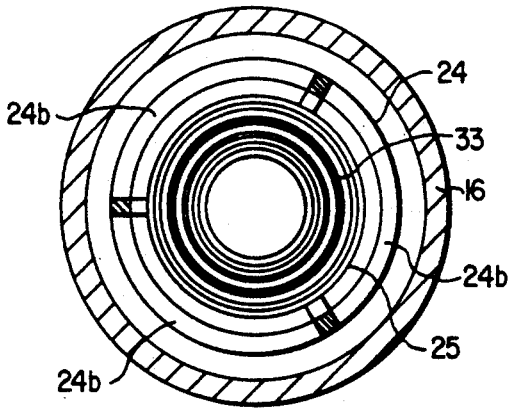
FIG. 3 is a cross-sectional drawing of the valve housing along line 3—3 of FIG. 2.
Figure 2A:
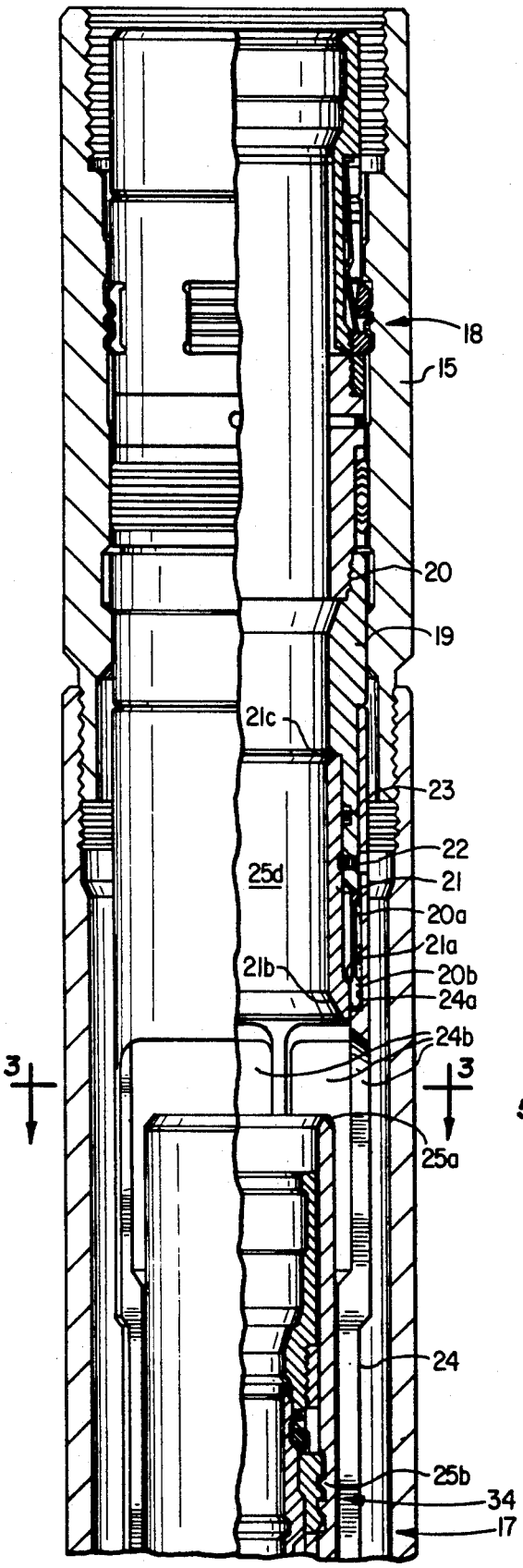
FIGS. 2A and 2B are an elevational drawing in partial section showing the system and safety valve of this invention in the open position with the flow restrictors in the maximum restriction position.

FIG. 2 shows an invention safety valve 17 has been connected on lock mandrel 18 and the lock mandrel has been lowered in the conduit to locate, seal and lock in the landing nipple. The safety valve has a connector 19 which is connected to the lock mandrel at 20. The connector has a number of collet fingers 20*a*, each having a lug portion 20*b*. An annular seat member 21 is releasably positioned in the connector by shearable pin 22 and sealed to the connector with resilient seal 23. The annular seat has a propping surface 21*a* and a sealing surface 21*b*. Valve housing 24 (see also FIG. 3) has an internal groove 24*a* in which lugs 20*b* are held engaged by seat propping surface 21*a* releasably connecting the valve housing to connector 19. The valve housing has a number of openings 24*b* for flow and an internal shoulder 24*c*. Slidably mounted in the valve housing is a valve member 25, which has a sealing surface 25*a*, locking recesses 25*b*, an external shoulder 25*c* and a through flow passage 25*d*. Mounted around the valve element between the valve housing and retained thereon by camming nut 26 is an adjustable bias 27 which biases the valve element to open position shown in FIG. 2. The adjustable bias includes a spring 27*a* and a number of spacers 27*b*. Camming nut 26 has a camming surface 26*a* slidably engaging surfaces 28*a* on restrictor segments 28, which extend through a number of slots 26*b* in the camming nut. Each slot has a wider portion 26*c* into which restrictor segments 28 are inserted and moved into narrower slot 26*b* where slots 28*c* in each side of each segment slidably retain the segments in slot 26*b*—see FIG. 5. A ring 29 is slidably mounted in bore 26*c* with the lower end of the ring in sliding contact with lever surfaces 28*b* on restrictor segments 28. The upper end of an outer ring 30 around the camming nut is held in contact with the bottom surfaces of the restrictor segments by compressed spring 31 bearing on shoulder 32*a* on retainer guide 32 connected into the camming nut.

FIG. 2 shows that automatic sensing actuator 33 has been connected to lock mandrel 34 with sealing connection 35 on the surface and lowered into valve member flow passage 25*d*. The lock mandrel has located, sealed and been operated to lock in locking recesses 25*b* in the valve member with sensing actuator shoulder 33*a* contacting surface 29*a* on ring 29.

Sensing actuator 33 includes a connector 36, into which is connected a variable volume pressure chamber 37. This pressure chamber includes a connector 38, a bellows 39 and a closure 40. The connector and closure are sealed to the bellows by brazing or welding and the closure has a shoulder 40*a* and an inlet 40*b*, which is shown to be closed with a sealing plug 41. The pressure chamber may be evacuated or pressurized as required and closed by installing plug 41.

Surrounding the pressure chamber and housed in cylinder 42 is a compressed spring 43 which bears on upper cylinder shoulder 42*a* and the other end of the spring bears on an actuating member 44, which is slidably connected over the cylinder by wire 45 passed through hole 44*a* and semi-circular groove 44*b* and elongate groove 42*b* around cylinder 42. The length of groove 42*b* limits longitudinal travel of the actuating member on the cylinder. Spring 43 engages actuating member surface 44*c* with shoulder 40*a* on closure 40.

Before installing the safety valve of this invention in a well, the landing nipple component of the invention system is installed in the well flow conduit to be at the proper depth after the flow conduit is lowered into the well. An invention safety valve is programmed on surface to automatically move from open to closed position at the desired mass flow rate of production by installing bias spring 27*a* of the proper rate and selecting an appropriate length of spacers 27*b*. Also, a spring 43 of correct rate is selected and installed and pressure chamber 37 is pressurized or evacuated to the desired pressure through closure inlet 40*b* and sealed with plug 41. By changing spring 43 to a spring with a lower or higher spring rate, the mass flow rate at closure can be decreased or increased as stored well pressure is increased. If a lower rate spring is selected, then the mass flow rate just before closure of the valve would decrease as stored pressure increased. The flow velocity would also decrease, but to a much larger extent. Conversely, a high rate spring would limit movement of the flow restrictors and allow a higher mass flow rate to occur before closure if the stored pressure was increased. Changing the compressive load on spring 43 will raise or lower the mass flow rate of closure. The length of retainer guide 32 may be increased to add weight and urge the valve toward open position.

The housing of safety valve 17 is now connected to lock mandrel connector 19 by positioning over the connector and moving annular seat propping surface 21*a* up inside collet finger lugs 20*b*. The annular seat is releasably positioned by installing pin 22. Sensing actuator 33 may now be installed in the safety valve or lowered in the well conduit and installed in the safety valve after it has been installed in the landing nipple. Lock mandrel 18 carrying safety valve 17 (with or without sensing actuator 33) is lowered into the flow conduit to locate, seal and operate to lock in landing nipple 15. Valve member 25 is biased to open position, and any quantity of fluid desired may be pumped down the flow conduit through lock mandrel 18, connector 19, annular seat 21 and out through housing openings 24*b* past restrictor segments 28 and into formation 12. If sensing actuator 33 has not been installed in the safety valve, flow passage 25*d* will be open for passage of pumped in or produced fluid or instruments through safety valve 17.

Figure 5:
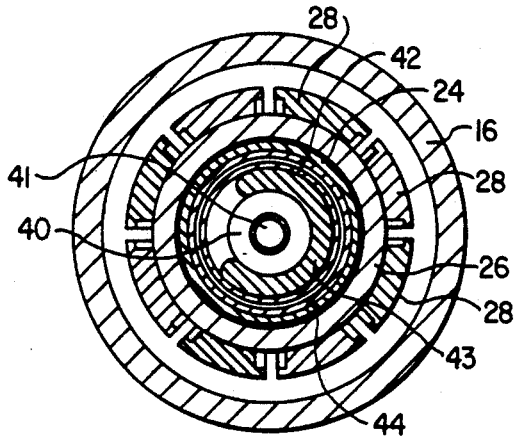
FIG. 5 is a cross-sectional drawing along line 5—5 of FIG. 2.
Figure 6:
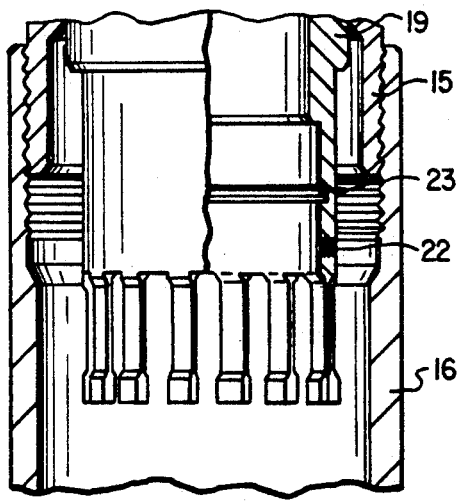
FIG. 6 is a drawing showing the upper portion of FIG. 2 after the valve housing has been expended.
Figure 2B:
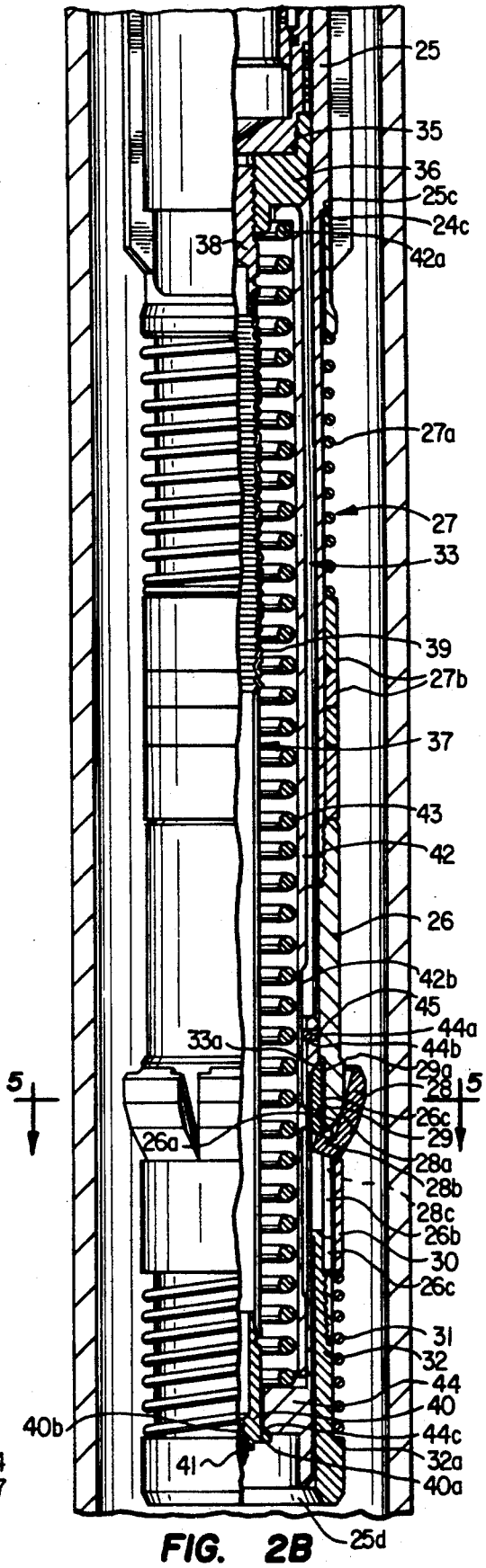
Figure 4:
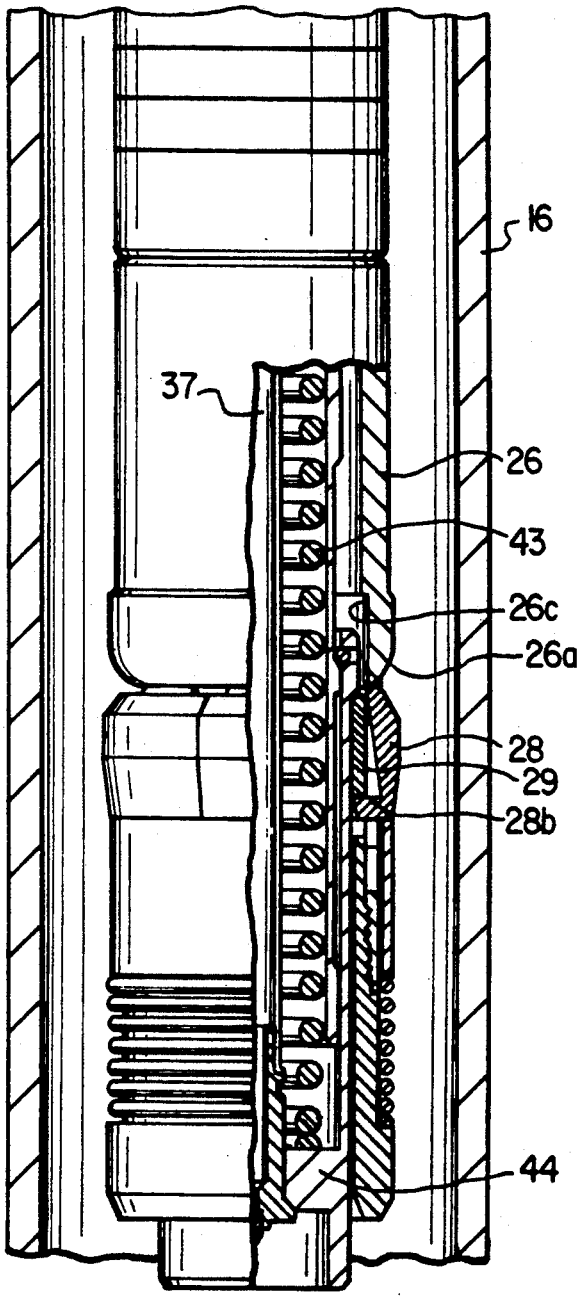
FIG. 4 is a sectioned drawing of the lower portion of FIG. 2 showing the flow restrictors in the minimum flow restriction position.

As the storage reservoir is filled, pressure therein increases. Reservoir pressure is constantly being sensed by pressure chamber 37 which may cause a shortening of bellows 39, upward movement of actuating member 44, compression of spring 43, permitting upward movement of ring 29 in camming nut bore 26c causing camming nut surface 26a to slide upward along segment camming surface 28a moving the restrictor segments outwardly to reduce the restricted flow area for closure at the programmed mass flow rate as shown in FIG. 2B and FIG. 5. If the sensed pressure permits extension of the bellows and spring, actuator 44 is moved downwardly, moving ring 29 and sliding segments 28 down camming nut surface 26a permitting the lower end of the ring in contact with segment surface 28b to tilt the segments inwardly increasing the restricted flow area (see FIG. 4) for valve closure at the desired mass flow rate.

When closing parameters for the well change or there is a need to run instruments through flow passage 25d, lock mandrel 34 and sensing actuator 33 may be retrieved from valve member 25 to surface where pressure in chamber 37 may be changed and/or spring 43 changed to a spring with another rate.

If desired, lock mandrel 18 and the entire invention safety valve 17 (with or without lock mandrel 34 and sensing actuator 33) may be retrieved to surface from landing nipple 15 for changing adjustable bias spring 27a and/or spacers 27b if changing well parameters require. As an alternate to retrieving, annular seat 21 may be operated to disconnect valve housing 24 from connector 19 permitting the valve housing (with or without lock mandrel 24 and sensing actuator 33) to be expended downward in the flow conduit by applying sufficient downward force on annular seat bearing surface 21c to shear pin 22 and move propping surface 21a downward from inside lugs 20b.

I claim:

1. A system for controlling flow in a well conduit comprising:

(a) a landing nipple in said conduit;

(b) a lock mandrel sealably engageable and releasably lockable in said landing nipple;

(c) a safety valve controlling production flow in said conduit connected to said lock mandrel, said safety valve programmable for closure at various predetermined ratios of mass flow rate and ambient pressure and includes:

a housing having openings for flow between the outside and inside thereof, a connector for connecting said housing to said lock mandrel, an annular seat slidably and sealably mounted and releasably positioned in said connector, valve member means slidably mounted in said housing, said valve member means moveable from open position permitting production flow through said housing openings to closed position where said valve member means sealingly engages said annular seat and prevents production flow through said openings, adjustable biasing means on said valve member means for biasing said valve member means toward open position, variable flow restriction means on said valve member means forming an annular flow passage with said well conduit, said flow restriction means for varying the annular restricted flow passage area, variable sensing means for automatically sensing ambient pressure and engaging said variable flow restriction means to vary said flow passage area for safety valve closure at the predetermined flow rate-ambient pressure ratio, said sensing means sealably engageable and releasably lockable in said valve member means; and (d) means for connecting and disconnecting said safety valve to and from said lock mandrel.

2. The system of claim 1 wherein the valve member means is open for passage of well tools therethrough on retrieval of the sensing means.

3. A system according to claim 1 wherein the valve member means includes a valve member mounted for longitudinal movement in the housing, said valve member having a seal surface thereon and a seal bore and locking recesses therein.

4. A system according to claim 3 wherein the safety valve adjustable biasing means on the valve member comprise:

(a) at least one spacer ring mounted around said valve member; and (b) a spring mounted around said valve member between said spacer and the housing.

5. A system according to claim 3 wherein the safety valve variable flow restriction means comprise:

(a) a camming nut connected on the valve member, said camming nut having a camming surface, a bore and a number of slots therethrough;

(b) a restrictor segment slidably and pivotally mounted in each said slot, each said segment having a surface slidably engageable with said nut camming surface and a lever surface;

(c) a ring slidably mounted in said camming nut bore, said ring lower end engageable with said segment lever surfaces;

(d) an outer ring slidably mounted around said camming nut below said restrictor segments, said outer ring engaging the lower end of each segment;

(e) a retainer guide having a shoulder connected to said camming nut; and (f) a spring mounted around said camming nut between said guide shoulder and said outer ring.

6. A system according to claim 3 wherein the safety valve variable sensing means comprises:

(a) a lock mandrel for sealing and releasably locking in the valve member bore and locking recesses;

(b) a variable volume pressure chamber having a closure with a shoulder, said pressure chamber connected to said lock mandrel;

(c) a cylinder having an internal shoulder and an external elongated groove, said cylinder disposed around said pressure chamber;

(d) an actuating member having an external shoulder, an internal shoulder and a surface engageable with said closure shoulder, said actuating member slidably connected around said cylinder;

(e) means for slidably connecting said actuating member around said cylinder; and (f) a spring around said pressure chamber between said actuating member internal shoulder and said cylinder internal shoulder, said spring biasing said cylinder to engage said lock mandrel and said actuating member to engage said closure.

7. A system according to claim 6 wherein the means for slidably connecting the safety valve sensing means actuating member around the cylinder comprises:

(a) an internal semi-circular groove in the actuating member;
(b) an opening into said groove; and
(c) a wire passed through said opening into said actuating member groove and the elongated groove around the cylinder.

8. A system according to claim 1 wherein the means for connecting and disconnecting the safety valve from the lock mandrel comprises:
(a) a number of collet fingers on the connector, each said finger having a lug thereon;
(b) the housing further including an internal groove;
(c) the annular seat further including a bearing surface and a propping surface; and
(d) a shearable pin through said connector into said annular seat positioning said annular seat propping surface inside said lugs, propping said lugs into engagement with said housing groove and connecting said safety valve housing to said connector and lock mandrel, said safety valve housing disconnectable from said connector on application of sufficient force on said annular seat bearing surface to shear said pin and move said annular seat propping surface from inside said lugs.

9. A system for controlling flow in a well conduit comprising:
(a) a landing nipple in said conduit;
(b) a lock mandrel sealably engageable and releasably lockable in said landing nipple;
(c) a safety valve for controlling production flow in said conduit connected to said lock mandrel, said safety valve programmable for closure at various predetermined ratios of mass flow rate and ambient pressure and includes:
a housing having openings for flow from outside to inside said housing,
a connector for connecting said housing to said lock mandrel,
an annular seat having a seal surface thereon slidably and sealably mounted and releasably positioned in said connector,
a valve member mounted for longitudinal movement in said housing, said valve member having a seal surface thereon and a seal bore and locking recesses therein, said valve member moveable from open position permitting production flow through said housing openings to closed position where said valve member seal surface sealingly engages said annular seat seal surface and prevents production flow through said housing openings,
adjustable biasing means on said valve member for biasing said valve member toward open position, said biasing means including:
at least one spacer ring mounted around said valve member, and
a spring mounted around said valve member between said spacer and said housing,
variable flow restriction means on said valve member forming an annular flow passage with said well conduit, said flow restriction means for varying said annular flow passage area, said flow restriction means including:
a camming nut connected on said valve member, said camming nut having a camming surface, a bore and a number of slots therethrough,
a restrictor segment slidably and pivotally mounted in each said slot, each said segment having a surface slidably engageable with said nut camming surface and a lever surface;
a ring slidably mounted in said camming nut bore, said ring lower end engageable with said segment lever surfaces;
an outer ring slidably mounted around said camming nut below said restrictor segments, said outer ring engaging the lower end of each said segment;
a retainer guide having a shoulder connected to said camming nut, and
a spring mounted around said camming nut between said guide shoulder and said outer ring, sensing actuator means for automatically sensing ambient pressure and engaging said variable flow restriction means for varying said restricted flow area for safety valve closure at the predetermined flow rate-ambient pressure ratio, said sensing actuator means sealably engageable and releasably lockable in said valve member, said sensing actuator means including:
a lock mandrel for sealing and releasably locking in the valve member bore and locking recesses,
a variable volume pressure chamber having a closure with a shoulder, said pressure chamber connected to said lock mandrel,
a cylinder having an internal shoulder and an external elongated groove, said cylinder disposed around said pressure chamber,
an actuating member having an external shoulder, an internal shoulder and a surface engageable with said closure shoulder, said actuating member slidably connected around said cylinder,
means for slidably connecting said actuating member around said cylinder, said connecting means including:
an internal semi-circular groove in the actuating member,
an opening into said groove, and a wire passed through said opening into said actuating member groove and the elongated groove around the cylinder,
means for connecting and disconnecting said safety valve to and from said lock mandrel, said connecting and disconnecting means including:
a number of collet fingers on the connector, each said finger having a lug thereon, the housing further including an internal groove,
the annular seat further including a bearing surface and a propping surface, and a shearable pin through said connector into said annular seat positioning said annular seat propping surface inside said lugs, propping said lugs into engagement with said housing groove and connecting said safety valve housing to said connector and lock mandrel, said safety valve housing disconnectable from said connector on application of sufficient force on said annular seat bearing surface to shear said pin and move said annular seat propping surface from inside said lugs.

10. A retrievable subsurface safety valve programmable to close at various predetermined ratios of production mass flow rate and ambient pressure comprising:
(a) a connector connectible to a lock mandrel;
(b) a housing having openings for flow between the outside and inside thereof;
(c) an annular seat slidably and sealably mounted and releasably positioned in said connector;

(d) a valve member slidably mounted in said housing, said valve member moveable from open position permitting production flow through said housing openings to closed position where said valve member sealingly engages said annular seat and prevents production flow through said openings, (e) adjustable biasing means on said valve member for biasing said valve member toward open position, (f) variable flow restriction means on said valve member forming an annular flow passage with the well conduit, said restriction means for varying said annular flow passage area, (g) sensing actuator means for automatically sensing ambient pressure and engaging said variable flow restriction means for varying said annular flow passage area for safety valve closure at the predetermined flow rate-ambient pressure ratio, said sensing means sealably engageable and releasably lockable in said valve member; and (h) means for connecting and disconnecting said housing from said connector.

11. The safety valve of claim 10 wherein the valve member is open for passage of well tools therethrough on retrieval of the sensing actuator means from the valve member.

12. The safety valve of claim 10 wherein the valve member includes a seal surface thereon and a seal bore and locking recesses therein.

13. The safety valve of claim 12 wherein the adjustable biasing means comprise:

(a) at least one spacer ring mounted around said valve member; and (b) a spring mounted around said valve member between said spacer and the housing.

14. A safety valve according to claim 10 wherein the variable flow restriction means comprise:

(a) a camming nut connected on the valve member, said camming nut having a camming surface, a bore and a number of slots therethrough;

(b) a restrictor segment slidably and pivotally mounted in each said slot, each said segment having a surface slidably engageable with said nut camming surface and a lever surface, each said segment further including a slot on each side of said segment through said lever surface;

(c) a ring slidably mounted in said camming nut bore, said ring lower end engageable with said segment lever surfaces;

(d) an outer ring slidably mounted around said camming nut below said restrictor segments, said outer ring engaging the lower end of each segment;

(e) a retainer guide having a shoulder connected to said camming nut; and (f) a spring mounted around said camming nut between said guide shoulder and said outer ring.

15. A safety valve according to claim 10 wherein the variable sensing actuator means comprise:

(a) a lock mandrel for sealing and releasably locking in the valve member;

(b) a variable volume pressure chamber having a closure with a shoulder, said pressure chamber connected to said lock mandrel;

(c) a cylinder having an internal shoulder and an external elongated groove, said cylinder disposed around said pressure chamber;

(d) an actuating member having an external shoulder, an internal shoulder and a surface engageable with said closure shoulder, said actuating member slidably connected around said cylinder;

(e) means for slidably connecting said actuating member around said cylinder; and (f) a spring around said pressure chamber between said actuating member internal shoulder and said cylinder internal shoulder, said spring biasing said cylinder to engage said lock mandrel and said actuating member to engage said closure.

16. A safety valve according to claim 15 wherein the means for slidably connecting the actuating member around the cylinder comprises:

(a) an internal semi-circular groove in the actuating member;

(b) an opening into said groove; and (c) a wire passed through said opening into said actuating member groove and the elongated groove around the cylinder.

17. A safety valve according to claim 10 wherein the means for connecting and disconnecting the housing from the connector comprises:

(a) a number of collet fingers on the connector, each said finger having a lug thereon;

(b) the housing further including an internal groove;

(c) the annular seat further including a bearing surface and a propping surface; and (d) a shearable pin through said connector into said annular seat positioning said annular seat propping surface inside said lugs, propping said lugs into engagement with said housing groove and connecting said safety valve housing to said connector and lock mandrel, said safety valve housing disconnectable from said connector on application of sufficient force on said annular seat bearing surface to shear said pin and move said annular seat propping surface from inside said lugs.

18. A retrievable subsurface safety valve programmable to close at various predetermined ratios of production mass flow rate and ambient pressure comprising:

(a) a connector having a number of collet fingers, each said finger having a lug thereon;

(b) a housing having an internal groove and openings for flow between the outside and inside thereof;

(c) an annular seat having a seal surface thereon slidably and sealably mounted and releasably positioned in said connector, (d) a valve member slidably mounted in said housing, said valve member moveable from open position permitting production flow through said housing openings to closed position where said valve member sealingly engages said annular seat seal surface and prevents production flow through said openings, (e) adjustable biasing means on said valve member for biasing said valve member toward open position, (f) variable flow restriction means on said valve member forming an annular flow passage with a well conduit, said flow restriction means for varying said annular flow passage area, (g) sensing actuator means for automatically sensing ambient pressure and engaging said variable flow restriction means for varying said restricted flow area for safety valve closure at the predetermined flow rate-ambient pressure ratio, said sensing means sealably engageable and releasably lockable in said valve member, said sensing actuator means including:

a lock mandrel for sealing and releasably locking in said valve member, a variable volume pressure chamber having a closure with a shoulder, said pressure chamber connected to said lock mandrel, a cylinder having an internal shoulder and an external elongated groove, said cylinder disposed around said pressure chamber, an actuating member having an external shoulder, an internal shoulder and a surface engageable with said closure shoulder, said actuating member slidably connected around said cylinder, means for slidably connecting said actuating member around said cylinder, said slidable connecting means including:

an internal semi-circular groove in the actuating member, an opening into said groove, and a wire passed through said opening into said actuating member groove and the elongated groove around the cylinder;

(h) means for connecting and disconnecting said housing from said connector, said connecting and disconnecting means including:

a number of collet fingers on the connector, each said finger having a lug thereon, the housing further including an internal groove, the annular seat further including a bearing surface and a propping surface, and a shearable pin through said connector into said annular seat positioning said annular seat propping surface inside said lugs, propping said lugs into engagement with said housing groove and connecting said safety valve housing to said connector and lock mandrel, said safety valve housing disconnectable from said connector on application of sufficient force on said annular seat bearing surface to shear said pin and move said annular seat propping surface from inside said lugs.

* * * * *